US005232428A

United States Patent [19]

Jambor

[11] Patent Number: 5,232,428

[45] Date of Patent: Aug. 3, 1993

[54] CARTON BLANK SUPPORT TOOL FOR A FOLDER GLUER MACHINE

[75] Inventor: George Jambor, Jackson, Wis.

[73] Assignee: Oetlinger Tool Engineering Co., Inc., Grafton, Wis.

[21] Appl. No.: 899,737

[22] Filed: Jun. 17, 1992

[51] Int. Cl.[5] ..... B65H 45/12

[52] U.S. Cl. ..... 493/177; 493/183; 493/422; 493/453

[58] Field of Search ..... 493/177, 182, 183, 422, 493/453

[56] References Cited

U.S. PATENT DOCUMENTS 2,291,063 7/1942 Staude ..... 493/183
2,774,286 12/1956 La Bombard ..... 493/177

*Primary Examiner*—Bruce M. Kisliuk
*Assistant Examiner*—Jack Lavinder
*Attorney, Agent, or Firm*—Andrus, Sceales, Starke & Sawall

[57] ABSTRACT

A carton blank support member is mounted above a traveling carton blank in a folder gluer machine. The support member is cyclicly driven between an inoperative position above the carton blank to an operative position engaging the top surface of the blank adjacent a score line formed in the blank. The score line defines a flap which is folded upwardly when the support member is in engagement with the top surface of the carton blank to form a side wall of the carton. The support member prevents the flap from buckling during the folding operation, especially when recycled paperboard is used as the carton blank.

13 Claims, 2 Drawing Sheets

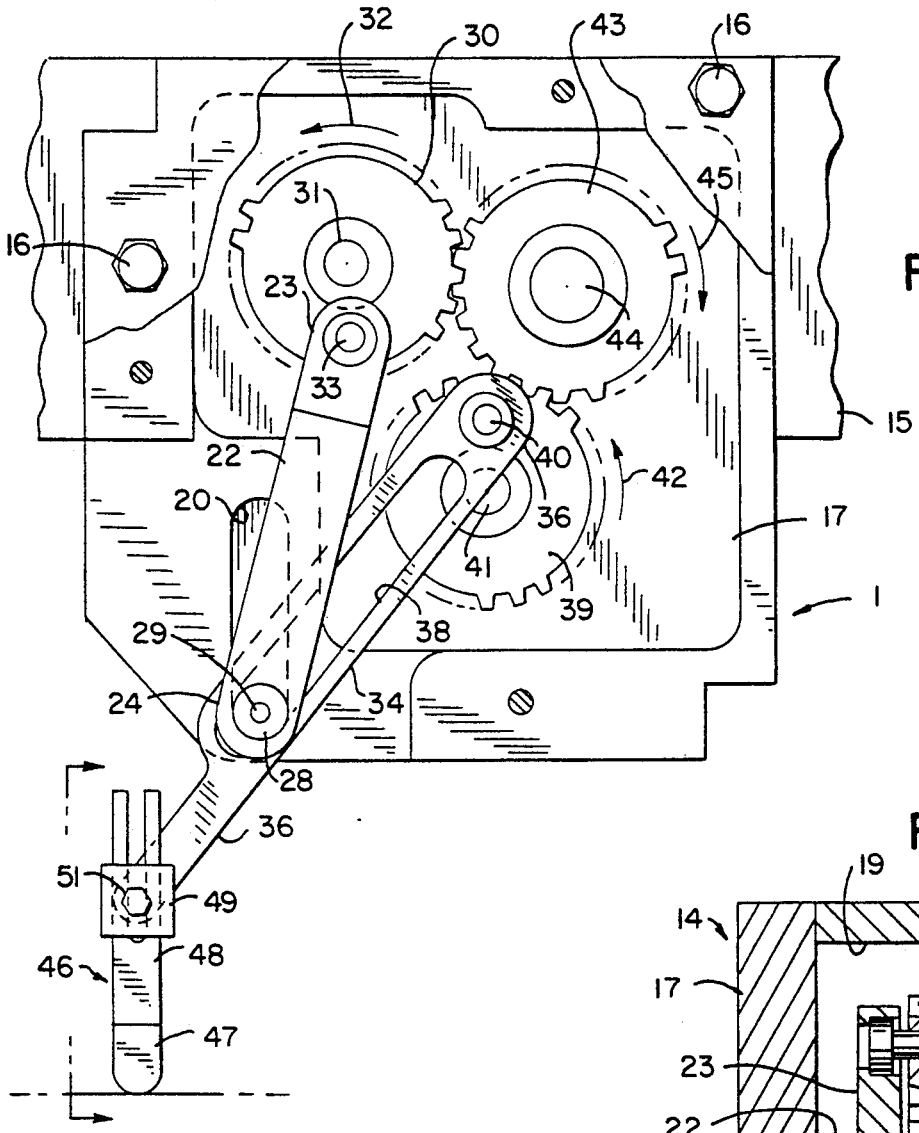
FIG. 3
FIG. 4
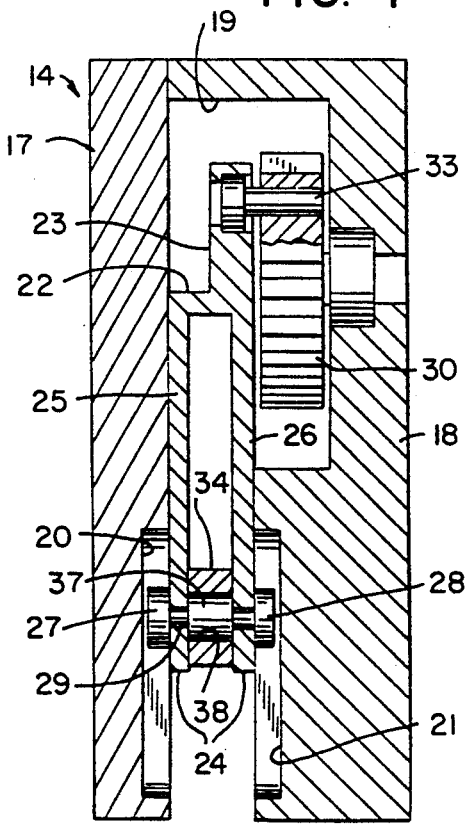
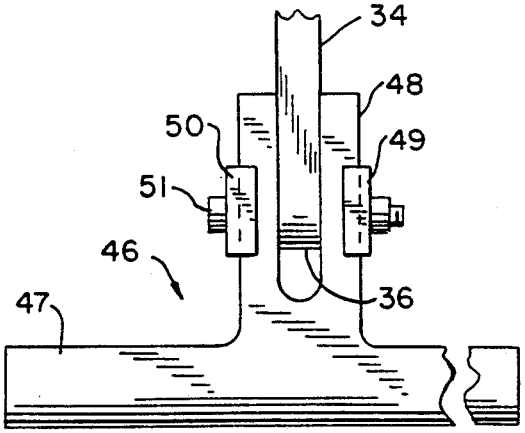
FIG. 5

CARTON BLANK SUPPORT TOOL FOR A FOLDER GLUER MACHINE

BACKGROUND OF THE INVENTION

The present invention relates to folder gluer machines for making paper cartons from a traveling carton blank, and more particularly to a support tool for temporarily supporting the top surface of the carton blank during a folding operation.

When making paper cartons, a traveling carton blank which has previously been cut to the appropriate shape and scored to define a main carton portion and at least one flap, is sent to a folder gluer machine for folding the flap to form a side wall of the carton and to glue the side walls together. Such paper cartons are typically employed in retail stores for boxing clothing or other similar items where a rigid carton is not required. In the folder gluer machine, a folding hook is typically employed to rotate and engage the bottom surface of the carton flap to bend the flap along the score line and form the side wall of the carton. The carton blank is typically traveling in a direction perpendicular to the score line so that the folding hook must be operated in timed relation to the speed of the traveling blank.

One problem that has developed in folder gluer machines is that occasionally a carton flap will buckle or kink when the folding hook engages its bottom surface. This results in improper carton formation and subsequent jamming of the blank in the folder gluer machine. The machine must then be stopped and cleared of the jam resulting in undesirable down time for the entire carton making operation. It has been found that this buckling or kinking occurs especially when employing recycled paperboard for the carton blank since recycled paperboard has little fibre or grain structure to provide "body" for the blank.

SUMMARY OF THE INVENTION

A carton blank support member is mounted above a traveling carton blank in a folder gluer machine. The support member is cyclicly driven between an inoperative position above the carton blank to an operative position engaging the top surface of the blank adjacent a score line formed in the blank. The score line defines a flap which is folded upwardly when the support member is in engagement with the top surface of the carton blank to form a side wall of the carton. The support member prevents the flap from buckling during the folding operation, especially when recycled paper board is used as the carton blank.

The drive mechanism for moving the carton blank support member between its operative and inoperative positions preferably comprises a first link having upper and lower ends mounted for longitudinal movement so that the lower end moves in a rectilinear motion, a second link having inner and outer ends mounted for longitudinal movement and slidably interconnected intermediate its ends with the lower end of the first link for movement therewith so that its outer end moves from a first position above the carton blank to a second position above the carton blank but closer to the carton blank than said first position, and drive means connected to the upper end of the first link and the inner end of the second link for independently driving these links in their respective longitudinal movements. Preferably, the drive means comprises a set of three intermeshing gears driven in timed relation to the speed of the carton blank. Preferably, the carton blank support member is connected to the outer end of the second link for movement therewith such that when engaging the top surface of the carton blank the support member is traveling at the same rate of speed as the carton blank.

Another aspect of the invention is a method of folding a carton blank comprising the steps of moving a carton blank having a top and bottom surface and a score line defining a main carton portion and a flap in a first direction, said first direction being perpendicular to the score line, supporting the carton blank along at least a portion of its bottom surface, moving a carton support tool cyclicly between an inoperative position above the blank and an operative position temporarily engaging the top surface of the blank, and folding the flap upwardly along the score line toward the top surface when the tool is in engagement with the top surface to form a side wall of a carton. Preferably, the support tool is moved at the same rate of speed as the carton blank and in the same direction as the carton blank when engaging the top surface of the blank.

BRIEF DESCRIPTION OF THE DRAWINGS

The drawings illustrate the best mode presently contemplated of carrying out the invention.

In the drawings:

FIG. 3 is a view similar to FIG. 1 illustrating the support tool in its operative position engaging a carton blank;

FIG. 4 is a cross-sectional view taken along the plane of the line 4—4 in FIG. 2; and FIG. 5 is a fragmentary elevation of the support tool taken along the plane of the line 5—5 in FIG. 3.

DETAILED DESCRIPTION OF THE PREFERRED EMBODIMENT

Figure 1:
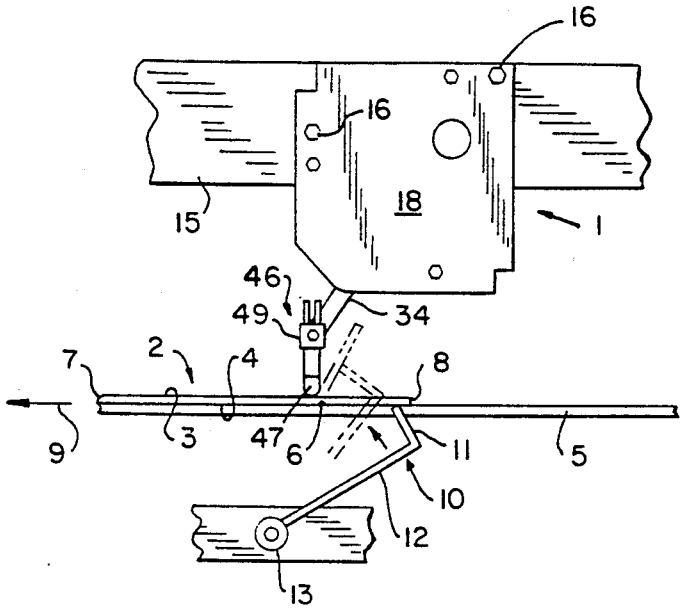
FIG. 1 is a side view in elevation of a folding operation in a folder gluer machine.
Figure 2:
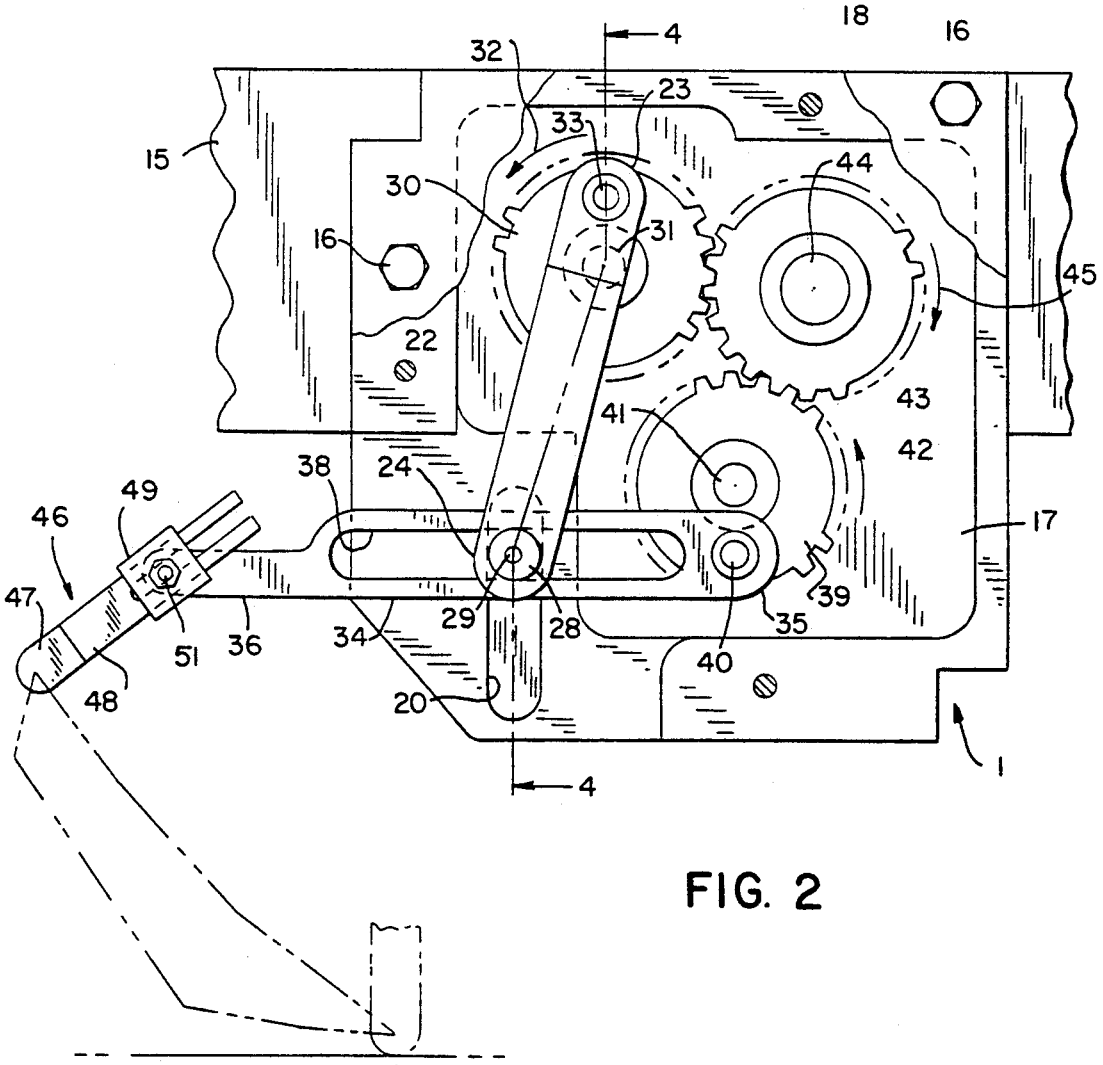
FIG. 2 is a fragmentary side view in elevation with parts broken away of a carton blank support apparatus constructed in accordance with the present invention and illustrating the support tool in its inoperative position.

Referring now to the drawings, FIGS. 1–3 illustrate a carton blank support apparatus generally designated by the numeral 1 for use in connection with a folder gluer machine for making paper cartons from a traveling carton blank 2. The paper cartons are employed for boxing numerous goods, such as clothing and the like where a non-rigid carton is desirable. Apparatus 1 is preferably employed with blank 2 which is composed of recycled paperboard since such board has minimal fibre structure to give "body" to the paperboard during a folding operation. However, apparatus 1 may be employed with other types of paperboard stock and should not be construed as being limited to use with recycled paperboard.

Upon entering apparatus 1, carton blank 2 includes an unsupported top surface 3 and a supported bottom surface 4. Support for bottom surface 4 is provided in any conventional manner such as by conveyor belt 5. It should also be noted that carton blank 2 has been cut to the appropriate shape and provided with a score line 6 formed therein prior to entering the folder gluer machine where apparatus 1 is located. Score line 6 defines a main carton portion 7 which eventually becomes the bottom of a carton and a flap 8 which eventually becomes a side wall of the carton. Carton blank 2 is traveling in a direction indicated by arrow 9 which is perpendicular to the longitudinal extent of score line 6. In order to fold flap 8 upwardly along score line 6 toward top surface 3 to form the side wall of the carton, a folding hook 10 is rotated in the same direction as arrow 9 and in timed relation to the speed of carton blank 2. As shown, hook 10 is L-shaped and includes a finger 11 formed at 90° to an arm 12. Arm 12 is connected to a rotating shaft 13 which as noted above is rotating in timed relation to the speed of carton blank 2 so that the tip of finger 11 engages the bottom surface 4 of flap 8 to fold flap 8 upwardly as blank 2 is traveling downstream in the folder gluer apparatus, as is conventional.

Apparatus 1 comprises a means for temporarily supporting top surface 3 of carton blank 2 at a location adjacent score line 6 during a folding operation. Apparatus 1 includes a stationary housing 14 supported above the traveling carton blank 2. Housing 14 is mounted on a bracket 15 forming part of the folder gluer machine by a pair of bolts 16. As shown best in FIG. 4, housing 14 includes a back plate 17 and a cover plate 18 defining an interior chamber 19 for receiving the drive components of apparatus 1. As shown best in FIG. 4, chamber 19 is open at its lower end. Back plate 17 also includes a vertically extending race or channel 20 formed therein, and cover plate 18 includes a corresponding vertically extending race or channel 21 disposed opposite of race 20.

A first link 22 includes an elongate body having upper and lower opposite ends 23 and 24 respectively. Link 22 is mounted for longitudinal movement within chamber 19 of housing 14 so that lower end 24 moves in a rectilinear motion. As shown best in FIG. 4, lower end 24 of link 22 is bifurcated to form a pair of spaced arms 25 and 26. The rectilinear motion of lower end 24 is provided by a pair of bearings 27 and 28 mounted outside arms 25 and 26 respectively which are captured within races 20 and 21 for rolling vertical movement therein. A pin 29 extends through bearings 27 and 28 to mount bearings 27 and 28 to the lower ends of arms 25 and 26.

The upper end 23 of link 22 is connected to a first idler gear 30 mounted for rotation within housing 14 on an axle 31 defining a first axis of rotation. As shown best in FIG. 2, gear 30 rotates counterclockwise in the direction of arrow 32. The upper end 23 of link 22 is connected to gear 30 for rotation therewith by means of a crank pin 33. Thus, upper end 23 of link 22 rotates in a circular motion while lower end 24 moves vertically in a rectilinear motion.

Apparatus 1 also includes a second link 34 having an elongate body with inner and outer opposite ends 35 and 36 respectively. Link 34 is also mounted for longitudinal movement within housing 14 and is slidably interconnected intermediate its outer and inner ends 35 and 36 with lower end 24 of link 22 for movement therewith so that outer end 36 of link 34 moves from a first position above carton blank 2 (see FIG. 2) to a second position above carbon blank 2 which is closer to carton blank 2 than its first position (see FIG. 3). The motion of outer end 36 is shown in phantom in FIG. 2. The longitudinal movement of link 34 is provided by a rotary cam follower 37 disposed between lower ends 24 of arms 25 and 26 of link 22 which in turn is disposed within an elongate opening 38 formed in link 34 intermediate its inner and outer ends 35 and 36. Cam follower 37 is mounted on pin 29 for rotation thereon within opening 38. The inner end 35 of link 34 is connected to a second idler gear 39 by means of a crank pin 40. Gear 39 is mounted for rotation within housing 14 on a second axle 41 defining an axis of rotation parallel to axle 31. Gear 39 rotates in the same direction as gear 30 i.e. counterclockwise as indicated by arrow 42.

A drive gear 43 is mounted for rotation within housing 14 on an axle 44 which defines an axis of rotation parallel to axles 31 and 41. Drive gear 43 intermeshes with gears 30 and 39 and is rotated in a direction opposite to that of gears 30 and 39 i.e. in a clockwise direction as indicated by arrow 45. Drive gear 43 is rotated in timed relation to shaft 13 of folding hook 10 so that the movement of outer end 36 of link 34 is proportional to the traveling speed of carton blank 2.

As shown best in FIG. 5, a carton blank support member 46 in the form of a T-shaped tool is connected to outer end 36 of link 34. Tool 46 includes a cylindrically shaped head 47 for engaging top surface 3 of carton blank 2 and a neck 48 connected to outer end 36. Head 47 extends across substantially the entire width of carton blank 2 to provide the necessary support, and has a length of between 4 inches to 24 inches depending upon the width of carton blank 2. As shown best in FIGS. 3 and 5, neck 48 is double bifurcated and thus straddles outer end 36 of link 34. Neck 48 is clamped onto outer end 36 by means of a pair of clamping plates 49 and 50 and a bolt 51 extending through plates 49 and 50 as well as neck 48 and outer end 36 of link 34. Thus, tool 46 may be adjustably mounted at an appropriate orientation with respect to outer end 36 so that head 47 moves from an inoperative position above carbon blank 2 when outer end 36 is in its first position (see FIG. 2) to an operative position engaging the top surface 3 of carton blank 2 adjacent score line 6 during a folding operation (see FIG. 3) when outer end 36 is in its second position.

In operation, rotation of drive gear 43 causes gears 30 and 39 to be rotated so that link 22 transmits the rotary motion of gear 30 to a vertical linear motion to move link 34 upwardly and downwardly. At the same time, rotation of gear 39 moves link 34 inwardly and outwardly so that tool 46 moves between its inoperative position above blank 2 to an operative position temporarily engaging and supporting top surface 3 of blank 2 during a folding operation. The movement of tool 46 is such that when it engages top surface 3 of carton blank 2 tool 46 is traveling at the same rate of speed as carton blank 2 and in the same direction as blank 2.

Various modes of carrying out the invention are contemplated as being within the scope of the following claims particularly pointing out and distinctly claiming the subject matter regarded as the invention.

I claim:

1. In a folder gluer apparatus for making paper cartons from a traveling carton blank having a supported bottom surface and an unsupported top surface, said carton blank having a score line formed therein defining a carton flap, and folding means for folding said flap upwardly along said score line toward said top surface to form a side wall of a carton, a carton blank support apparatus for temporarily supporting the top surface of said carton blank during a folding operation, said carton blank support apparatus comprising:

a stationary housing supported above said traveling carton blank;

a first link having an elongate body with upper and lower opposite ends, said first link mounted for longitudinal movement within said housing so that said lower end moves in a rectilinear motion;

a second link having an elongate body with inner and outer opposite ends, said second link mounted for longitudinal movement within said housing and slidably interconnected intermediate its outer and inner ends with the lower end of said first link for movement therewith so that the outer end of said second link moves from a first position above said carton blank to a second position above said carton blank and closer to said carton blank than said first position;

drive means connected to the upper end of said first link and the inner end of said second link for independently driving said first and second links in their respective longitudinal movements; and a carton blank support member connected to the outer end of said second link for movement therewith from an inoperative position above said carton blank when said outer end is in its first position to an operative position engaging the top surface of said carton blank adjacent said score line during a folding operation when said outer end is in its second position.

2. The carton blank support apparatus of claim 1 wherein the movement of the outer end of said second link is such that when engaging the top surface of said carton blank said support member is traveling at the same rate of speed as said carton blank.

3. The carton blank support apparatus of claim 1 wherein said drive means comprises a first gear mounted for rotation in a first direction within said housing about a first axis, first connecting means for connecting the upper end of said first link to said first gear for rotation therewith, a second gear mounted for rotation within said housing about a second axis parallel to said first axis in the same direction as said first gear, second connecting means for connecting the inner end of said second link to said second gear for rotation therewith, and means for rotating said first and second gears in said first directions.

4. The carton blank support apparatus of claim 3 wherein said means for rotating said first and second gears comprises a drive gear mounted for rotation within said housing about a third axis parallel to said first and second axes and in the opposite direction as said first and second gears.

5. The carton blank support apparatus of claim 4 wherein said first and second connection means each comprises a crank pin.

6. The carton blank support apparatus of claim 1 wherein the lower end of said first link is bifurcated to form a pair of spaced arms and said second link passes between said spaced arms.

7. The carton blank support apparatus of claim 6 wherein the rectilinear motion of the lower end of said first link is provided by a vertically extending race formed in said housing and a bearing mounted outside of one of said arms, said bearing captured within said race for rolling movement therein.

8. The carton blank support apparatus of claim 7 wherein said second link includes an elongate opening formed therein intermediate its inner and outer ends, and the longitudinal movement of said second link is provided by a rotary cam follower disposed between said arms of said first links and disposed within said elongate opening.

9. The carton blank support apparatus of claim 1 wherein said carton blank support member comprises a T-shaped tool.

10. In a folder gluer apparatus for making paper cartons from a traveling carton blank having a supported bottom surface and an unsupported top surface, said carton blank having a score line formed therein defining a carton flap, and folding means for folding said flap upwardly along said score line toward said top surface to form a side wall of a carton, a carton blank support apparatus for temporarily supporting the top surface of said carton blank during a folding operation, said carton blank support apparatus comprising:

a carton blank support member mounted above said traveling carton blank for movement from an inoperative position above said blank to an operative position engaging the top surface of said blank adjacent said score line during a folding operation; and drive means for moving said carton blank support member cyclicly between said operative and inoperative positions in such a manner that when said carton blank support member is in said operative position, said support member is traveling at the same rate of speed as said carton blank and for moving said carton blank support member from said inoperative position to said operative position in a direction opposite the movement of the traveling blank.

11. The apparatus of claim 10 wherein the carton blank support member comprises a T-shaped tool having a head for engaging said blank and a neck connected to said drive means.

12. The apparatus of claim 11 wherein the direction of travel of said blank is perpendicular to the longitudinal dimension of the head of said tool.

13. A method of folding a carton blank comprising the steps of:

moving a carton blank having a top and bottom surface and a score line defining a main carton portion and a flap in a first direction, said first direction being perpendicular to said score line;

supporting said carton blank along at least a portion of its bottom surface;

moving a carton support tool cyclicly between an inoperative position above said blank and an operative position temporarily engaging the top surface of said blank in such a manner that when said carton blank support member is in said operative position, said support member is traveling at the same rate of speed as said carton blank and moving said carton blank support member from said inoperative position to said operative position in a direction opposite the movement of the traveling blank; and folding said flap upwardly along said score line toward said top surface when said tool is in engagement with said top surface to form a side wall of a carton.

* * * * *